US009496659B2

(12) United States Patent
McRae

(10) Patent No.: US 9,496,659 B2
(45) Date of Patent: Nov. 15, 2016

(54) GROUNDING APPARATUS FOR A SAFETY GROUNDED TREE

(71) Applicant: NCP Corporation, Cranford, NJ (US)

(72) Inventor: Michael McRae, Ormond Beach, FL (US)

( * ) Notice: Subject to any disclaimer, the term of this patent is extended or adjusted under 35 U.S.C. 154(b) by 45 days.

(21) Appl. No.: 14/667,193

(22) Filed: Mar. 24, 2015

(65) Prior Publication Data

US 2015/0194774 A1 Jul. 9, 2015

Related U.S. Application Data

(63) Continuation-in-part of application No. 14/317,291, filed on Jun. 27, 2014, now Pat. No. 9,402,498.

(51) Int. Cl.

| | |
|---|---|
| ***H01R 13/648*** | (2006.01) |
| ***H01R 24/22*** | (2011.01) |
| ***A47G 33/06*** | (2006.01) |
| *H01R 103/00* | (2006.01) |
| *H01R 4/30* | (2006.01) |
| *H01R 4/34* | (2006.01) |
| *H01R 4/64* | (2006.01) |
| *H01R 11/12* | (2006.01) |

(52) U.S. Cl.

CPC ..... *H01R 24/22* (2013.01); *A47G 33/06* (2013.01); *H01R 13/648* (2013.01); *H01R 4/302* (2013.01); *H01R 4/34* (2013.01); *H01R 4/643* (2013.01); *H01R 11/12* (2013.01); *H01R 2103/00* (2013.01)

(58) Field of Classification Search

CPC H01R 13/68; H01R 13/648; H01R 85/2035; H01R 85/2045; H01R 4/643; H01R 4/60; H01R 23/688; H01R 23/6873

USPC ..... 439/95, 100, 108, 620.26, 0.3, 0.31

See application file for complete search history.

(56) References Cited

U.S. PATENT DOCUMENTS

| | | | | |
|---|---|---|---|---|
| 3,825,875 | A * | 7/1974 | Garrett | H01R 27/00 200/51 R |
| 3,924,914 | A * | 12/1975 | Banner | G01R 19/14 340/641 |
| 3,938,068 | A * | 2/1976 | Hagan | H01R 31/02 337/187 |
| 4,025,139 | A * | 5/1977 | Martucci | H01R 13/648 439/106 |
| 4,579,405 | A * | 4/1986 | Hirooka | H01R 9/2491 439/106 |
| 4,613,192 | A * | 9/1986 | Peterson | H01R 13/58 439/101 |

* cited by examiner

*Primary Examiner* — Hien Vu

(74) *Attorney, Agent, or Firm* — James M. Smedley LLC; James Michael Smedley, Esq.

(57) ABSTRACT

An artificial lighted tree is presented with power routed through the trunk of the tree and three-wire safety grounding. The tree is divided into sections for easy assembly, disassembly, and storage. Safety electrical connectors at the ends of each section are not powered until the sections are assembled. The tree can also accommodate multiple lighting circuits utilizing different voltages simultaneously.

6 Claims, 4 Drawing Sheets

GROUNDING APPARATUS FOR A SAFETY GROUNDED TREE

RELATED APPLICATIONS

This application is a continuation-in-part of and claims priority to U.S. patent application Ser. No. 14/317,291, entitled "Safety Grounded Tree" filed Jun. 27, 2014, the contents of which is herein incorporated by reference in its entirety.

FIELD OF THE INVENTION

The present invention generally relates to artificial lighted trees. Specifically, embodiments of the present invention provide for a decorative lighted Christmas tree with power routed through the trunk of the tree and three-wire safety grounding. The system provides ways for connecting hot, neutral, and ground wires from a power supply cord to the decorative lighted Christmas tree.

BACKGROUND OF THE INVENTION

Seasonal lights, such as those used in conjunction with Christmas trees, are well known in the art. These seasonal lights generally use two-wire conductors to provide power to each of the light bulbs on a particular strand. Since insulation covers the entire length of the wire and plug, risk of shock is minimal so grounding is not a major issue.

However, artificial pre-lighted Christmas trees, where the seasonal lights are incorporated on or with the tree, have become a popular alternative to both live trees and unlighted artificial trees. These trees are usually sectional for easy storage, with some lighted trees routing power for the lights up through the trunk of the tree with electrical connectors built into the ends of each tree section to distribute power to each section. This mechanism, although convenient, brings with it the risk of exposed conductors at every electrical junction. If these exposed conductors accidentally make contact with any other portion of the artificial tree, there is a risk of electric shock and other undesirable electrical dangers (e.g., fire).

Therefore, there is a need in the art for a lighted artificial Christmas tree with a 3-wire safety ground connection. These and other features and advantages of the present invention will be explained and will become obvious to one skilled in the art through the summary of the invention that follows.

SUMMARY OF THE INVENTION

Accordingly, it is an object of the present invention to provide an artificial lighted tree with power routed through a hollow trunk and three-wire electrical grounding, where the trunk itself is conductive and grounded.

According to an embodiment of the present invention, a power cord comprises: a male end comprising a hot prong, a neutral prong, and a ground prong wherein the male end is configured to plug into a three-prong grounded outlet; and a female end comprising: a first surface on the distal end of the power cord, a second surface non-coplanar to said first surface, a female electrical connector on said first end configured to receive a standard male two-prong non-polarized NEMA 1 plug, a ground connection extending from the second surface of said female end, said ground connection configured to attach to a ground point without blocking access to the female electrical connector.

According to an embodiment of the present invention, The power cord of claim 1 wherein the ground connection is a flexible ground wire extending from the female end, the ground wire terminated with an electrical connector configured to make an electrical connection to a ground point.

According to an embodiment of the present invention, the ground connection is a rigid ground tab extending from the female end and configured to make an electrical connection to a ground point.

According to an embodiment of the present invention, the female electrical connector is polarized.

According to an embodiment of the present invention, the female end further comprises: a concave rounded contour allowing the female end to lie flush against a convex rounded surface.

According to an embodiment of the present invention, the female end further comprises an attachment means configured to secure the female end to a device while simultaneously creating a ground electrical connection to the device.

According to an embodiment of the present invention, the power cord further comprises a foot switch configured to toggle on and off an electrical signal provided to the female end of the power cord.

According to an embodiment of the present invention, an electrical apparatus comprises: a three-prong safety-grounded power plug; a molded electrical box having a contoured back configured to sit flush against a device to which the molded electrical box is to be attached, the device having a corresponding contour; a hot wire, and a neutral wire, each electrically connected to the power plug and each entering the molded electrical box; a ground wire, electrically connected to a ground prong of the power plug; an attachment means for securing the electrical box to the device; an access panel configured to provide access to the inside of the electrical box; a fuse holder inside the electrical box, the fuse holder electrically connected in line with the hot wire.

According to an embodiment of the present invention, the attachment means is conductive and configured to make a ground connection with a ground point on the device; and the ground wire is electrically connected to the attachment means.

According to an embodiment of the present invention, the ground wire terminates in an electrical connector configured to make an electrical connection with a ground point of the device.

According to an embodiment of the present invention, the hot wire and the neutral wire exit the box and enter the device through a securing grommet.

According to an embodiment of the present invention, the electrical apparatus of claim 8 further comprising a lighted artificial tree having a conductive hollow trunk body wherein the device is the lighted artificial tree.

According to an embodiment of the present invention, a lighted artificial tree comprises: a hollow body having an electrically conductive wall; one or more inner electrical conductors situated inside the hollow body; one or more side electrical connectors accessible from the outside of the hollow body and electrically connected to the inner electrical conductors; a three-prong safety ground electrical cord comprising a ground conductor electrically connected to the electrically conductive wall of the hollow body.

According to an embodiment of the present invention, the three-prong safety ground electrical cord further comprises: a male end configured to plug into a power outlet; a female end configured to receive a standard two-prong non-polarized electrical plug; wherein the ground conductor extends from the electrical cord and terminates in a ground electrical connector configured to attach to the electrically conductive wall of the hollow body.

According to an embodiment of the present invention, the ground electrical connector is a ring terminal.

According to an embodiment of the present invention, the ground electrical connector is a conductive rigid tab.

According to an embodiment of the present invention, the female end is molded to fit the outer contour of the hollow body.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

The present invention generally relates to artificial lighted trees. Specifically, embodiments of the present invention provide for a decorative lighted Christmas tree with power routed through the trunk of the tree and three-wire safety grounding. The system provides ways for connecting hot, neutral, and ground wires from a power supply cord to the decorative lighted Christmas tree.

In general, the system described herein provides for a three prong safety grounded power cord to be attached to and provide a safety ground connection for a powered decorative tree. A grounding connection from the power cord is attached and electrically connected to the trunk of the powered decorative tree. The trunk is preferably electrically conductive or has an electrically conductive wall. Inside the trunk are electrical conductors for providing power to the lights of the powered decorative tree. According to one embodiment, these electrical conductors make hot and neutral connections by a standard two-prong plug that plugs into a female end of the three prong safety grounded power cord. Alternatively the hot and neutral conductors can by directly connected to the hot and neutral conductors of the three prong safety grounded power cord through electrical contact points of the powered decorative tree. Fuse connections are provided through a fuse box that the hot wire passes through or fuses are incorporated into a standard fused two-prong plug. The back side of the female end of the safety grounded power plug or the fuse box is molded to sit flush against the trunk of the powered decorative tree for more stable and safe attachment. A foot switch is also incorporated into the power cord to allow power to the powered decorative tree to be controlled without unplugging the power cord from the wall.

Figure 1:
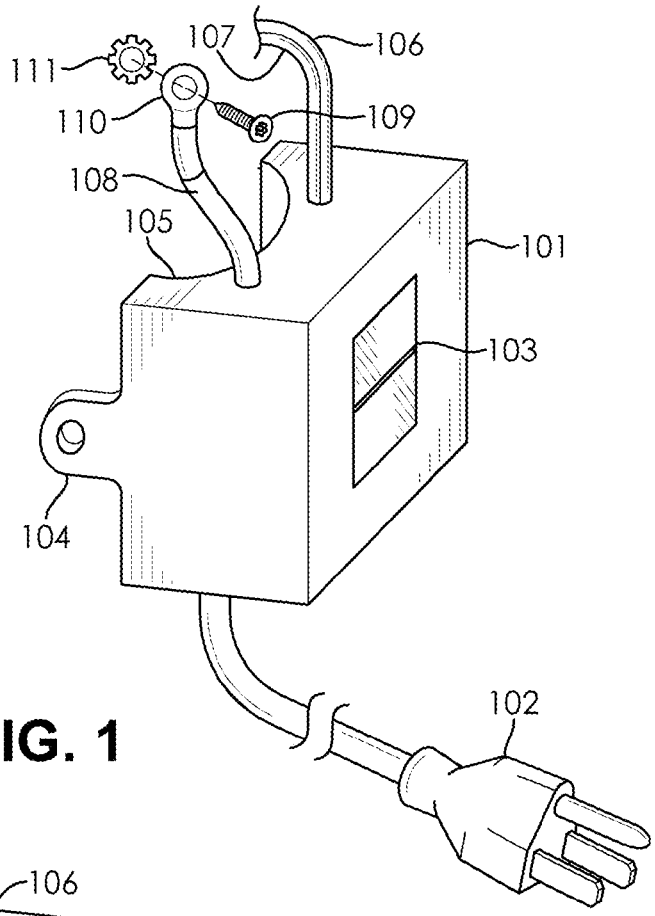
FIG. 1 shows a tree-mounted electrical box providing an interface between an electrical cord, a fuse, and a ground connection according to an embodiment of the present invention.

According to an embodiment of the present invention, FIG. 1 shows a molded electrical box 101 with a flange 104 on each side for securing the molded electrical box to the rounded trunk of a decorative lighted Christmas tree. A three-prong safety grounded plug 102 provides hot wire 106, neutral wire 106, and ground wire 108 to the molded electrical box 101. A notched access panel 103 slides out providing access for placing a fuse on at least the hot wire 106. Besides connecting the ground wire 108 to the decorative lighted Christmas tree, there are various possible connections that can be made in and around the molded electrical box 101 including, but not limited to: connecting the neutral wire 107 and ground wires 108 to each other and fusing the hot wire 106; fusing both the hot wire 106 and the neutral wire 107; or passing both the hot wire 106 and neutral wire 107 through the electrical box without fusing when fusing is done elsewhere on the tree. One or ordinary skill in the art would recognize that any method of fusing and grounding the wires could be used without departing from the spirit and scope of the present invention.

According to an embodiment of the present invention, A rounded back 105 of the electrical box 101 is molded to fit the curvature of the decorative lighted Christmas tree. This allows the flanges 104 and the molded back 105 of the electrical box 101 to sit flush against the decorative lighted Christmas tree and provide a secure connection that is less likely to shift or break from being bumped or nudged during assembly disassembly or general use of the decorative lighted Christmas tree. In place of the flanges 104, the electrical box can also be attached to the decorative lighted Christmas tree by way of an adhesive, glue, welding, or any other attachment means. One of ordinary skill in the art would understand that any kind of attachment means may be used to attach the electrical box to the decorative lighted Christmas tree without departing from the spirit and scope of the present invention.

According to an embodiment of the present invention, the ground wire 108 is connected to the conductive trunk of the decorative lighted Christmas tree by a ring terminal 110 electrically connected to the end of the ground wire 108. A tamper-proof screw 109 attaches to the conductive trunk of the decorative lighted Christmas tree through the ring terminal 110 and a star washer 111. The ground connection may also be made by soldering, welding, screw-down terminals, blade connectors, or any other kind of attachment means which makes an electrical connection. In an alternate embodiment, the ground wire bypasses the molded electrical box and connects directly to a ground point on the decorative lighted Christmas tree. One or ordinary skill in the art would recognize that any kind of electrical attachment means may be used without departing from the spirit and scope of the present invention.

Figure 2:
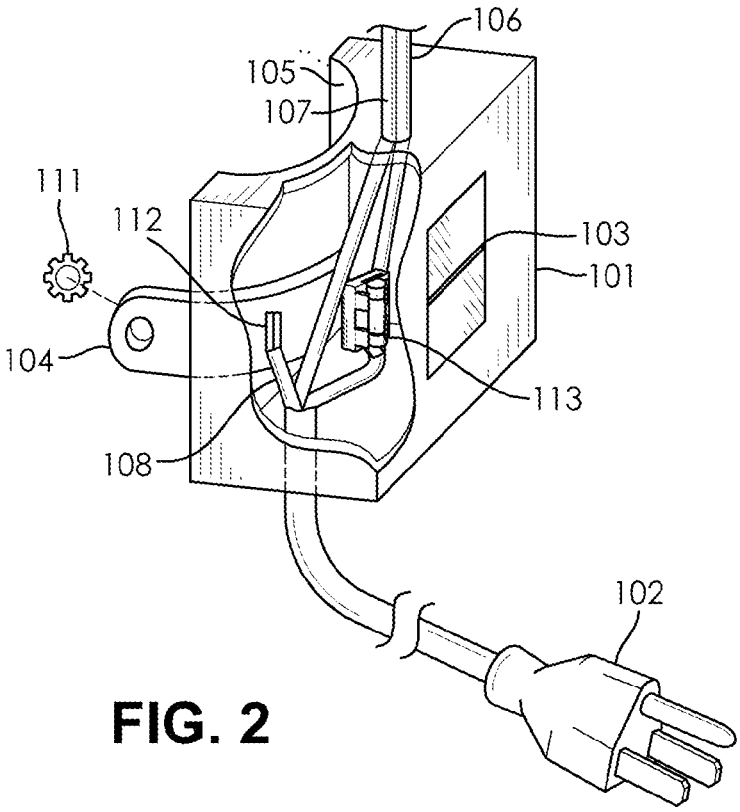
FIG. 2 shows a tree-mounted electrical box with a grounding base plate providing an interface between an electrical cord, a fuse, and a ground connection according to an embodiment of the present invention.

According to an embodiment of the present invention, FIG. 2 shows a molded electrical box 101 very similar to FIG. 1 except the flanges 104 are formed from a single piece of metal that extends through the back of the electrical box 101. The flanges 104 extend outside the electrical box 101, exposing a mounting hole which connects to the conductive trunk of the decorative lighted Christmas tree through a star washer 111. The ground wire 108 is welded 112 or otherwise electrically connected to the metal flanges 104 inside the electrical box 101. The preferred method of attaching the electrical box 101 to the decorative lighted Christmas tree trunk is by putting a tamper-proof screw through each flange into a bare metal attachment site on the trunk using a star washer. The electrical box 101 can also be attached to the trunk by welding, bolts, adhesives, straps, or any other kind of attachment means. Preferred attachment means would also produce an electrical connection between the trunk and the ground wire 108 electrically connected to the flanges 104. One or ordinary skill in the art would recognize that any attachment means could be used without departing from the spirit and scope of the present invention.

Figure 3:
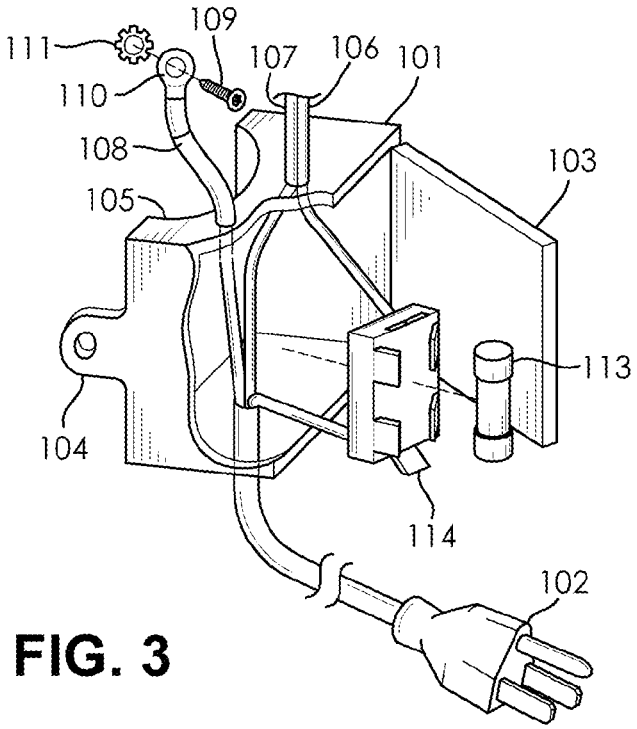
FIG. 3 shows a tree-mounted electrical box with an alternate access door, providing an interface between an electrical cord, a fuse, and a ground connection according to an embodiment of the present invention.

According to an embodiment of the present invention, FIG. 3 shows an alternate embodiment of the electrical box 101. The primary difference in the electrical box 101 of FIG. 3 is the access panel 103, which opens on a hinge and snaps shut rather than sliding out of a slot to reveal the fuse. The fuse 113 fits into a fuse holder 114 inside the electrical box 101. As in FIG. 1, the ground wire 108 passes through the electrical box 101 and fastens to the conductive trunk of the decorative lighted Christmas tree via a tamper-proof screw 109, a ring terminal 110, and a star washer 111. This creates a ground connection from the trunk to the ground wire 108 which is connected to the ground prong on the three-prong safety grounded plug 102.

Figure 4:
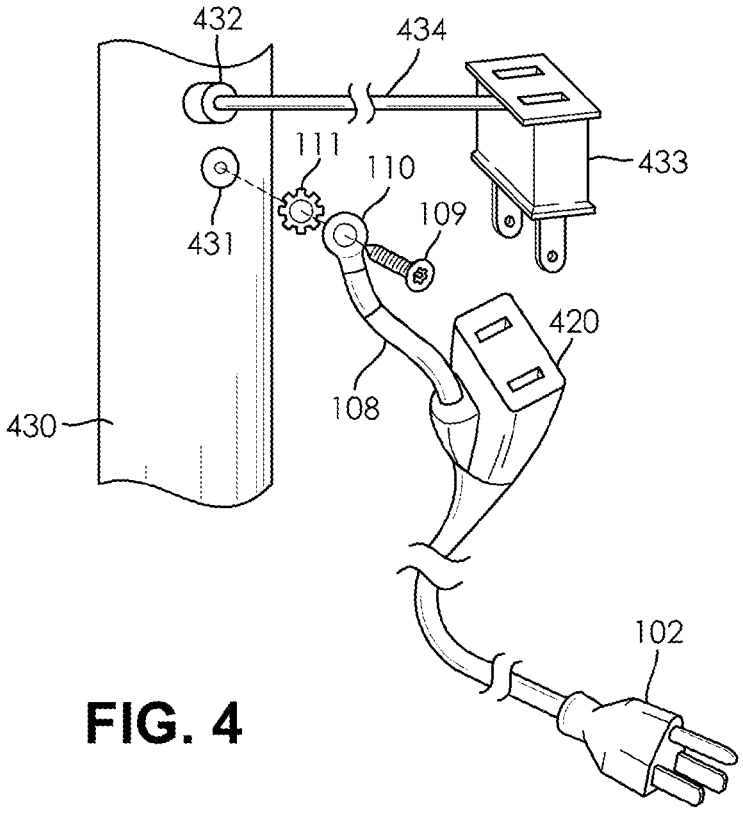
FIG. 4 shows a power cord and a powered decorative tree configured to connect to the power cord through a grounding point on the powered decorative tree according to an embodiment of the present invention.

According to an alternate embodiment of the present invention, FIG. 4 shows a power cord with a 3-prong safety grounded plug 102 on the male end and a modified female socket on the female end 420. The modified female socket may be polarized or non-polarized. Both polarized and non-polarized sockets are configured to accept a standard NEMA 1 two-prong non-polarized plug. The modified female socket is positioned on a first surface of the female end 420 and a second surface of the female end 420 is non-coplanar to the first surface. The term non-coplanar here can refer to any portion of the female end which is not on the plane defined by the face of the female socket on the first surface. Instead of having a rounded socket to receive a ground prong on the first surface, a ground wire 108 extends out from the second surface of the modified female socket and is terminated with a ring terminal 110. This ring terminal 110 is attached to a bare metal ground point 431 on the decorative lighted Christmas tree trunk 430 with a tamper-proof screw 109 and a star washer 111. The modified female socket at the end of the power cord is configured to receive a standard plug 433 often used in Christmas tree lights. The Conductors 434 from the standard plug 433 then pass into the inside of the trunk 430 through a securing grommet 432.

In the preferred embodiment the standard plug 433 is non-polarized because these plugs are commonly used in Christmas tree lighting and readily available. In a non-polarized plug, both the hot and neutral wires pass through fuses because there is no guarantee that the plug will be connected in a particular orientation. Alternatively, the standard plug 433 may be a polarized type. When the standard plug 433 is polarized, a single fuse is used on the hot wire, and the neutral wire may be grounded to the trunk of the decorative lighted Christmas tree at one or more places within the decorative lighted Christmas tree. Alternatively, a fuse may be placed in the 3-prong safety grounded plug 102 so that the fuse is electrically connected in line with the hot wire. In this case, only a single fuse is needed. For safety, the grounded plug 102 can be configured with a sliding door providing access to the fuse. The sliding door only slides open when the grounded plug is not plugged into a female socket.

Figure 5:
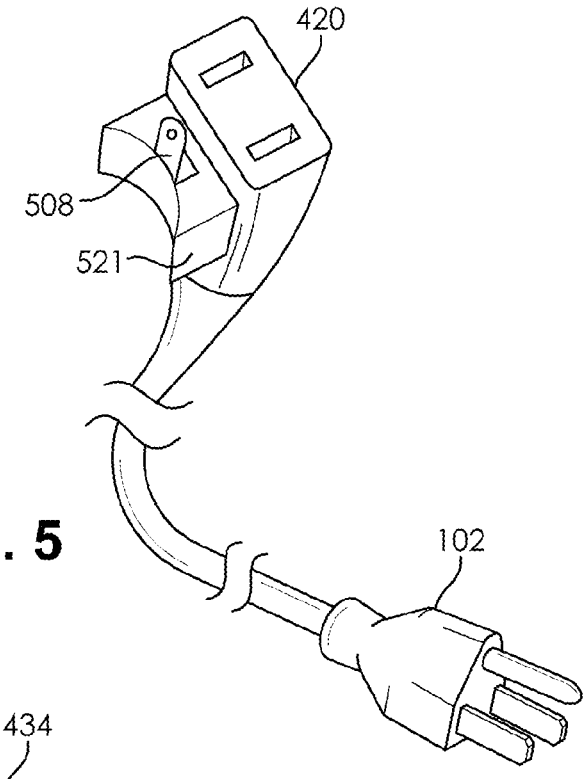
FIG. 5 shows a power cord with a female end which attaches to a powered decorative tree through the grounding point and is molded to fit the contour of the tree trunk according to an embodiment of the present invention.

According to an alternate embodiment of the present invention, FIG. 5 shows a different version of the power cord with a three-prong safety grounded plug 102 on the male end and a modified female socket on the female end 420. On the modified female socket of FIG. 5, the ground wire 108 is replaced with a ground prong 508. According to one embodiment the ground prong is bent at two 90 degree angles so that it lines up flush with the trunk 430 and the molded base 521 of the modified female socket. The molded base 521 of the female end 420 is curved to fit the rounded trunk of the decorative lighted Christmas tree. An important feature of the power cord depicted in both FIG. 4 and FIG. 5 is that the ground connection can be made independently of the hot and neutral connection (through the standard plug) without interfering with the ability of the standard plug to be plugged in and removed from the female end 420 of the power cord. One way of achieving this is by placing the ground connection on a surface other than the first surface where the female socket is placed.

Figure 6:
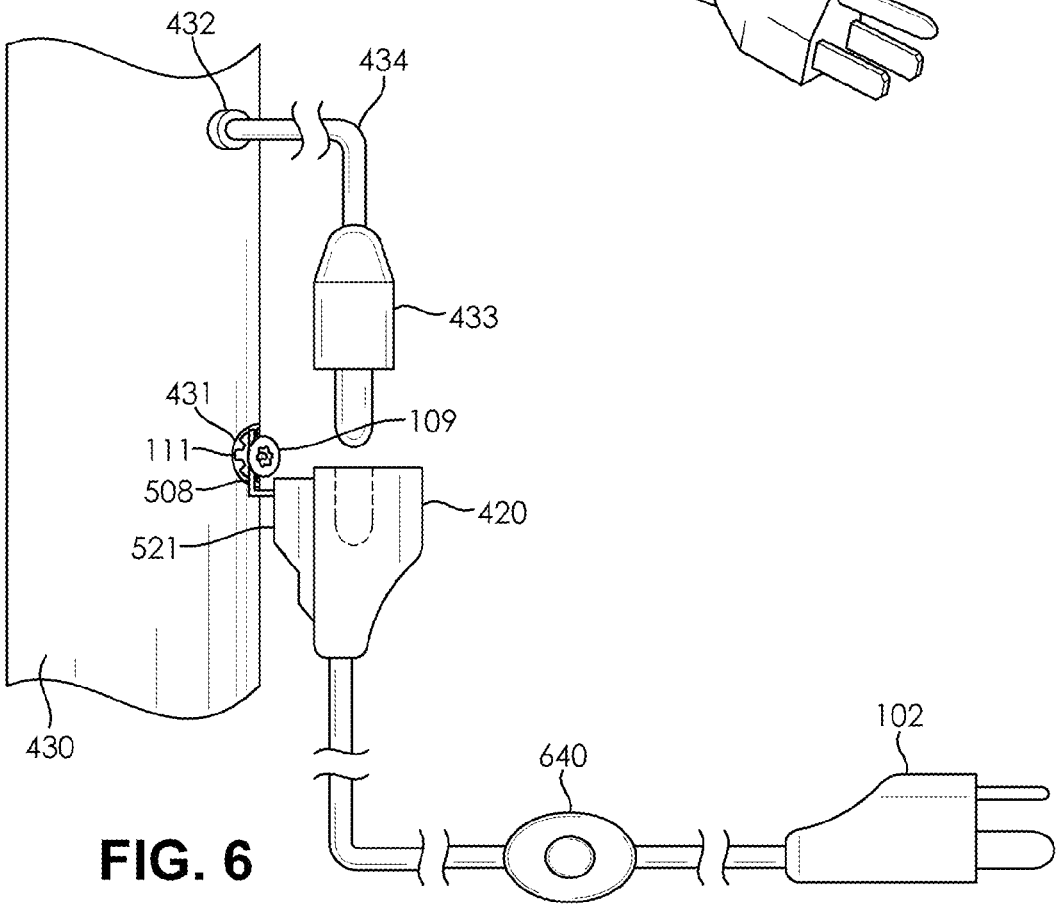
FIG. 6 shows a schematic diagram of a system for grounding a powered decorative tree with a foot switch for controlling power to the tree according to an embodiment of the present invention.

According to an alternate embodiment of the present invention, FIG. 6 shows the power cord of FIG. 5 attached to a bare metal ground point 431 on the conductive trunk 430 of the decorative lighted Christmas tree by a tamper-proof screw 109, and a star washer 111. Alternatively, welding, soldering, a screw-down terminal, or other attachment means can also be used to attach and electrically connect the ground prong 508 to the trunk 430. The ground prong allows the female end 420 to be secured to the trunk while simultaneously making a ground connection to the trunk. One or ordinary skill in the art would recognize that a ground prong 508 of any shape may be attached by any means to the trunk 430 without departing from the spirit and scope of the present invention. FIG. 6 also shows a foot switch 640 in line with the power cord. The foot switch 640 contains a push-button toggle switch which controls power to the decorative lighted Christmas tree. A non-polarized two-fused plug 433 plugs into the modified female socket 420 and the power wires 434 enter the trunk of the decorative lighted Christmas tree through a securing grommet 432. Power is distributed within the tree to various sockets, connectors, and/or light strings on the decorative lighted Christmas tree.

The optional foot switch 640 allows for controlling the lights. In other embodiments, the control of the lighting of the tree may be controlled by one or more control elements, such as a switch, a selector knob, an indicator panel, or any other human interface device (HID) or any combination thereof. One of ordinary skill in the art would appreciate that there are numerous types of control elements that could be utilized with embodiments of the present invention, and embodiments of the present invention are contemplated for use with any type of control element. According to another embodiment of the present invention, the foot switch may include electronics which convert the high voltage AC to low voltage DC and pass the ground connection through to the modified female socket 420 to allow for proper grounding even when high voltage AC is not used to run the lights on the decorative lighted Christmas tree.

Figure 7:
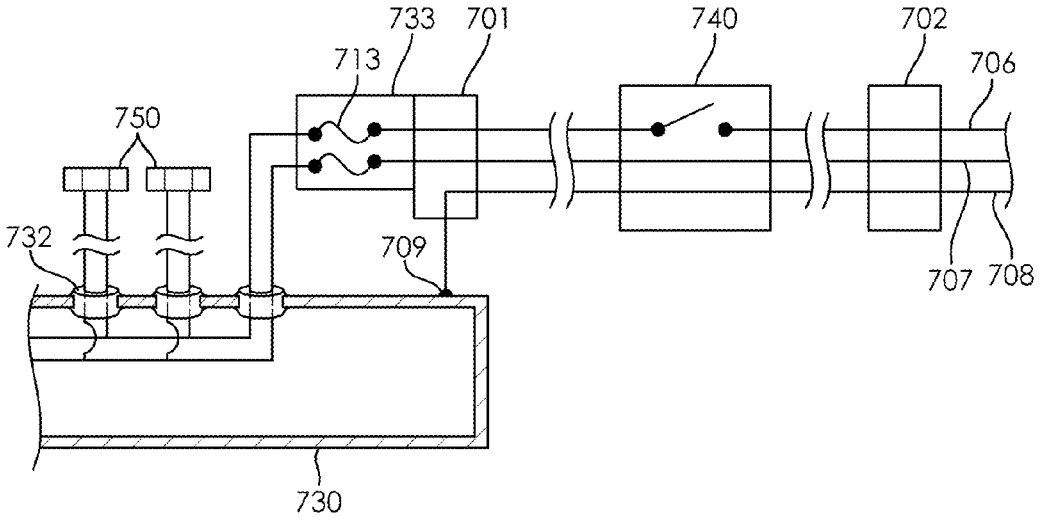
FIG. 7 shows a schematic diagram of a system for grounding a powered decorative tree according to an embodiment of the present invention.

According to another embodiment of the present invention, FIG. 7 shows a schematic diagram the safety grounded decorative lighted Christmas tree. The three-prong safety grounded plug 702 sends electrical conductors through a single pole switch 740. In one embodiment this switch is the foot switch 640 shown in FIG. 6. An electrical connector 701 is then grounded to the conductive trunk 730, creating a ground connection from the conductive trunk 730 to the ground wire 708 through an attachment means 709, such as a screw. The hot wire 706, and neutral wire 707 pass through the electrical connector 701 to a corresponding connector 733 that houses two fuses 713. Alternatively the fuses 713 can be housed in the electrical connector 701, or elsewhere on the tree. The hot wire 706 and neutral wire 707 then pass into the trunk 730 through a securing grommet 732 to route power throughout the inside of the trunk. Side connectors 750 outside the trunk are connected to the hot 706 and neutral 707 wires that pass through securing grommets 732 from inside the tree trunk 730 to outside the tree trunk 730. The side electrical connectors 750 may be as simple as a wire, electrically connected to the wires inside the tree trunk 730, and merely passing through a hole in the trunk 730 to the lights on the tree, or it may be a complex detachable multi-conductor connector as depicted in this application's parent application, U.S. patent application Ser. No. 14/317,291, entitled "Safety Grounded Tree" filed Jun. 27, 2014. One of ordinary skill in the art would appreciate that there are numerous types of side electrical connector that could be utilized with embodiments of the present invention, and embodiments of the present invention are contemplated for use with any appropriate type of side electrical connector.

One or ordinary skill in the art would recognize that wires are not necessary, and any conductor can be used, including, but not limited to, printed circuits, conductive paints, conductive liquids, or ionized gases. Embodiments of the present invention may incorporate one or more of these conductors in lieu of or in conjunction with the wires.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. An electrical apparatus comprising:

a three-prong safety-grounded power plug;

a molded electrical box having a cylindrically shaped contoured back configured to sit flush against a hollow trunk of a lighted artificial tree to which said molded electrical box is to be attached, said lighted artificial tree having a corresponding cylindrically shaped contour, said molded electrical box further having a first and second flange on respective sides of the molded electrical box for securing the electrical box to the trunk of the lighted artificial tree;

a hot wire, and a neutral wire, each electrically connected to said power plug and each entering said molded electrical box;

a ground wire, electrically connected to a ground prong of said power plug at a first distal end, the ground wire electrically connected to the conductive hollow trunk of the lighted artificial tree at a second distal end via a first attachment means is conductive;

a second attachment means in cooperation with said first and second flanges for securing said electrical box to said lighted artificial tree;

an access panel located on said electrical box configured to provide access to the inside of the electrical box;

a fuse holder inside said electrical box, said fuse holder electrically connected in line with said hot wire.

2. The electrical apparatus of claim 1 wherein said attachment means is configured to make a ground connection with a ground point on said lighted artificial tree; and wherein said ground wire is electrically connected to said attachment means.

3. The electrical apparatus of claim 1 wherein said ground wire terminates in an electrical connector configured to make an electrical connection with a ground point of said lighted artificial tree.

4. The electrical apparatus of claim 1 wherein said hot wire and said neutral wire exit the box and enter the lighted artificial tree through a securing grommet.

5. The electrical apparatus of claim 1 wherein the ground wire is electrically connected to the hollow conductive trunk of the lighted artificial tree at the second distal end by a screw, ring terminal and washer.

6. The electrical apparatus of claim 1 wherein the first and second flanges are formed from a single piece of metal that extends through the back of the electrical box.

* * * * *